US009037026B2

(12) United States Patent
Kurokawa

(10) Patent No.: US 9,037,026 B2
(45) Date of Patent: May 19, 2015

(54) FUSING DEVICE, IMAGE FORMING APPARATUS, AND METHOD OF CONTROLLING FUSING PRESSURE IN A FUSING DEVICE

(71) Applicant: KYOCERA Document Solutions Inc., Osaka (JP)

(72) Inventor: Yuichiro Kurokawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/279,074

(22) Filed: May 15, 2014

(65) Prior Publication Data

US 2014/0356007 A1 Dec. 4, 2014

(30) Foreign Application Priority Data

May 29, 2013 (JP) ..... 2013-112902

(51) Int. Cl.
*G03G 15/20* (2006.01)
*G03G 13/20* (2006.01)

(52) U.S. Cl.
CPC ..... *G03G 15/205* (2013.01); *G03G 13/20* (2013.01); *G03G 15/2067* (2013.01)

(58) Field of Classification Search
CPC ..... G03G 15/2067; G03G 15/2078; G03G 15/2089
USPC ..... 399/67, 70, 328, 331
See application file for complete search history.

(56) References Cited

U.S. PATENT DOCUMENTS

2010/0008683 A1* 1/2010 Yoshikawa ..... 399/45
2010/0303493 A1* 12/2010 Hamby et al. ..... 399/67
2011/0170920 A1* 7/2011 Fujiwara et al. ..... 399/331
2011/0200342 A1* 8/2011 Furuyama ..... 399/18
2011/0222874 A1* 9/2011 Yamada ..... 399/33

FOREIGN PATENT DOCUMENTS

JP 2008-216549 A 9/2008

* cited by examiner

*Primary Examiner* — Rodney Bonnette
(74) *Attorney, Agent, or Firm* — Stein IP, LLC

(57) ABSTRACT

A fusing device has a heater, a fusing rotary member heated thereby, a pressing rotary member in contact with the fusing rotary member to form a fusing nip, an adjustment mechanism adjusting a fusing pressure to adjust the nip width of the fusing nip, a temperature sensing member, and a control portion. By the control portion, the fusing pressure is set at a first set value during fusing warm-up operation for raising temperature of the fusing rotary member, is set at a third set value when a first sheet of paper after completion of fusing warm-up operation passes through the fusing nip, and is changed to a second set value before sheets of paper for a preset number of pages pass through the fusing nip after completion of fusing warm-up operation. Of the set values, the third is greatest, the second is second greatest, and the first is smallest.

13 Claims, 7 Drawing Sheets

| DURING FUSING WARM-UP (1ST SET VALUE) | |
|---|---|
| NIP WIDTH | SMALL OR NULL |
| FUSING PRESSURE | LOW OR NULL |

| DURING PRINTING OF 1ST SHEET (3RD SET VALUE) | |
|---|---|
| NIP WIDTH | LARGE |
| FUSING PRESSURE | HIGH |

| DURING PRINTING OF 2ND SHEET | |
|---|---|
| NIP WIDTH | LARGE TO MEDIUM |
| FUSING PRESSURE | HIGH TO MEDIUM |

| DURING PRINTING OF nTH SHEET (2ND SET VALUE) | |
|---|---|
| NIP WIDTH | MEDIUM |
| FUSING PRESSURE | MEDIUM |

| DURING FUSING WARM-UP (1ST SET VALUE) | |
|---|---|
| NIP WIDTH | SMALL OR NULL |
| FUSING PRESSURE | LOW OR NULL |

| DURING PRINTING OF 1ST SHEET (3RD SET VALUE) | |
|---|---|
| NIP WIDTH | LARGE |
| FUSING PRESSURE | HIGH |

| DURING PRINTING OF 2ND SHEET (2ND SET VALUE) | |
|---|---|
| NIP WIDTH | MEDIUM |
| FUSING PRESSURE | MEDIUM |

FUSING DEVICE, IMAGE FORMING APPARATUS, AND METHOD OF CONTROLLING FUSING PRESSURE IN A FUSING DEVICE

CROSS-REFERENCE TO RELATED APPLICATIONS

This application is based upon and claims the benefit of priority from the corresponding Japanese Patent Application No. 2013-112902, filed on May 29, 2013, the entire contents of which are incorporated herein by reference.

BACKGROUND OF THE INVENTION

The present disclosure relates to a fusing device for fusing a toner image to paper, an image forming apparatus incorporating a fusing device, and a method of controlling fusing pressure in a fusing device.

An image forming apparatus that prints with toner is provided with a fusing device for fusing toner transferred to paper. The fusing device is provided with a heating rotary member and a pressing rotary member, and paper having a toner image transferred thereon is passed through a nip between the heating rotary member and the pressing rotary member. This permits the toner image on the paper to be fused to the paper. When the main power to the image forming apparatus is turned on, or when a recovery is made from a power-save mode, a heater provided in the fusing device is energized to perform fusing warm-up operation whereby the heating rotary member is heated to a temperature adequate for fusing. Here, the heating rotary member is in contact with the pressing rotary member, and thus the heat of the heating rotary member is absorbed by the pressing rotary member. As a result, when the first page after fusing warm-up operation is printed, the heating rotary member may not be hot enough to completely fuse toner, resulting in defective fusing.

As a solution to such defective fusing on the first page after fusing warm-up operation, the following technology has been known. Specifically, according to the technology, an image forming apparatus includes a fusing roller, a pressing roller for pressing recording paper against the fusing roller, a heater for heating the fusing roller, and a temperature adjusting means for controlling the heater based on the output of a temperature sensor to adjust the temperature of the fusing roller, and is further provided with a second fusing temperature adjusting means for adjusting, for fusing on recording paper for the first page in response to the first instruction requesting fusing after start-up, the temperature of the fusing roller at, as a target temperature, a second fusing temperature higher than a first fusing temperature. With this configuration, fusing for the first page after start-up is performed at a temperature higher than the first fusing temperature. It is thereby intended to prevent insufficient heating by the heater resulting from the heat of the fusing roller being absorbed by a component nearby, such as the pressing roller, or by recording paper.

On the other hand, to reduce user waiting times and improve user convenience, there have conventionally been made attempts to reduce the time that elapses after a user operation, such as turning-on of the main power, before output of a print (often referred to as the "first print time"). The first print time can be reduced effectively by reducing the time required by fusing warm-up operation.

Here, to be sure, the conventional technology mentioned above can prevent defective fusing during printing of the first page after fusing warm-up operation. However, for fusing on recording paper for the first page after start-up, the temperature of the fusing roller is set at the second fusing temperature higher than the first fusing temperature. That is, before fusing on paper is started, the temperature of the fusing roller needs to be raised up to the second fusing temperature. Thus, the conventional technology mentioned above requires a longer time for fusing warm-up operation. Inconveniently, this results in a longer first print time.

SUMMARY OF THE INVENTION

According to one aspect of the present disclosure, a fusing device includes a heater, a fusing rotary member, a pressing rotary member, an adjustment mechanism, a temperature sensing member, and a control portion. The heater generates heat when energized. The fusing rotary member is heated by the heat from the heater. The pressing rotary member is in pressed contact with the fusing rotary member so as to form a fusing nip through which paper having a toner image transferred thereto is passed to fuse the toner image to the paper. The adjustment mechanism adjusts the fusing pressure under which the fusing rotary member and the pressing rotary member are in contact with each other at the fusing nip, thereby to adjust the nip width of the fusing nip. The temperature sensing member senses the temperature of the fusing rotary member. The control portion recognizes the temperature of the fusing rotary member based on the output from the temperature sensing member. Here, the control portion, when the temperature of the fusing rotary member is lower than a fusing control temperature adequate for fusing of the toner image, energizes the heater to raise the temperature of the fusing rotary member up to the fusing control temperature, thereby to perform fusing warm-up operation. Moreover, the control portion controls the adjustment mechanism such that, during the fusing warm-up operation, the fusing pressure is at a preset first set value; after completion of the fusing warm-up operation, with the fusing pressure at a preset third set value, the first sheet of paper is passed through the fusing nip; and the fusing pressure is changed to a preset second set value before sheets of paper for a preset number of pages pass through the fusing nip after completion of the fusing warm-up operation. Here, of the first, second, and third set values, the third set value is greatest, the second set value is second greatest, and the first set value is smallest.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Hereinafter, embodiments of the present disclosure will be described with reference to FIGS. 1 to 8. The following description deals with a multifunctional peripheral 100 as an example of an image forming apparatus including a fusing device 1. It should be understood, however, that none of the features specifically mentioned in terms of structure, arrangement, etc. in the course of the description of those embodiments are meant to limit the scope of the present disclosure.

Outline of an Image Forming Apparatus

Figure 1:
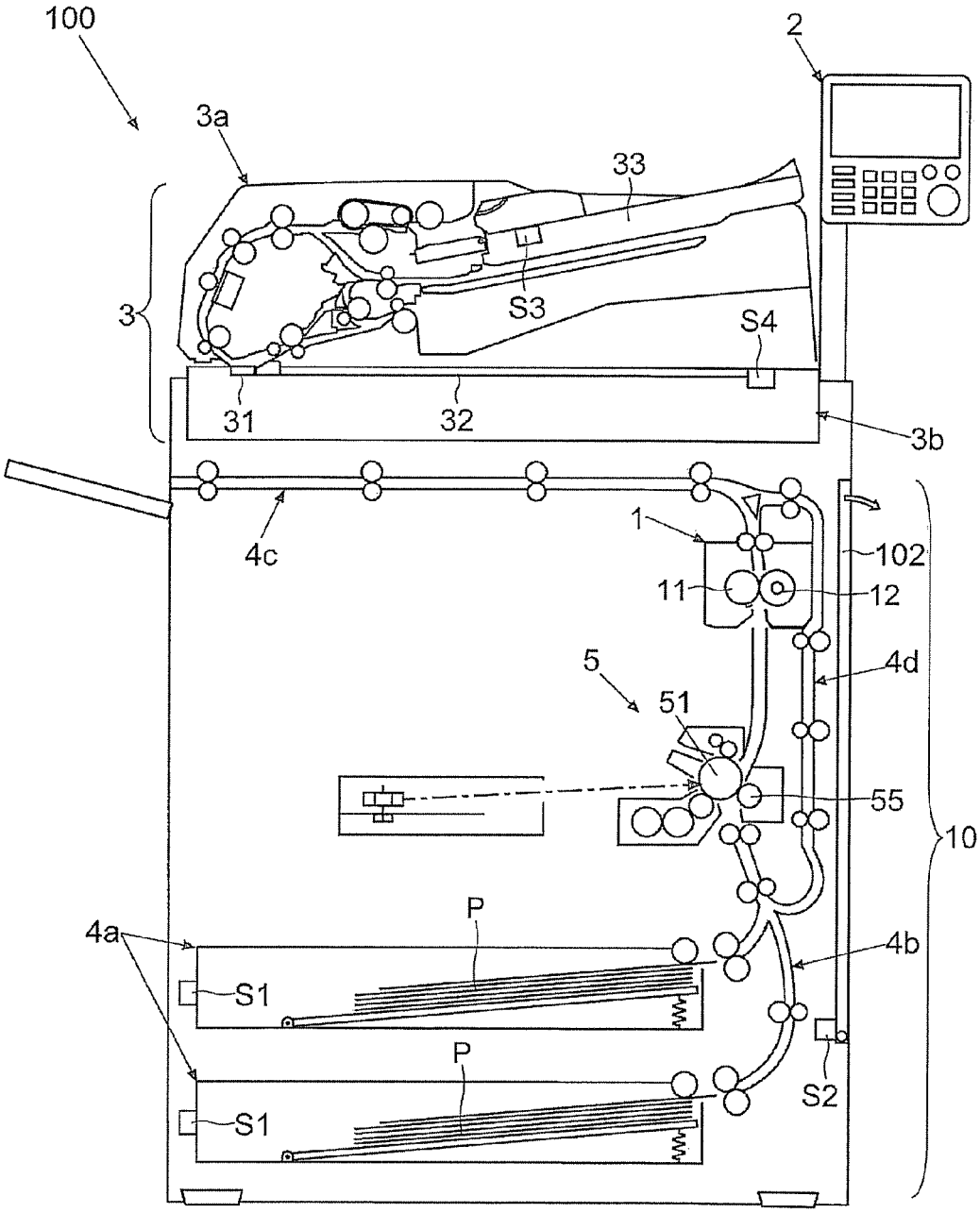
FIG. 1 is a diagram showing a construction of a multifunctional peripheral.

First, with reference to FIG. 1, an outline of the multifunctional peripheral 100 according to one embodiment will be described. FIG. 1 is a diagram showing the construction of the multifunctional peripheral 100 according to the embodiment.

As shown in FIG. 1, the multifunctional peripheral 100 according to the embodiment has an operation panel 2 attached at one side. The multifunctional peripheral 100 has, in an upper portion thereof, a reading section 3, which includes a document transport portion 3*a* and an image reading portion 3*b*. The multifunctional peripheral 100 has, inside it, a printing section 10, which includes a paper feed portion 4*a*, a first transport portion 4*b*, an image forming portion 5, a fusing device 1, and a second transport portion 4*c*.

As shown in FIG. 1, the operation panel 2 is provided to the upper right of the multifunctional peripheral 100. The operation panel 2 shows the status of the multifunctional peripheral 100, various messages, and setting screens, and accepts setting of conditions etc. for printing and transmission.

The document transport portion 3*a* transports, sheet by sheet, a document placed on a document tray 33 toward a reading position (a feed-reading contact glass 31). The image reading portion 3*b* reads a document that passes across the feed-reading contact glass 31 or that is placed on a stationary-reading contact glass 32, and generates image data of the document.

During printing, the paper feed portion 4*a* feeds out paper P. The first transport portion 4*b* transports the paper P fed from the paper feed portion 4*a* to the image forming portion 5. The image forming portion 5 forms a toner image based on the image data on a photosensitive drum 51. A transfer roller 55 transfers the toner image to the paper P.

The fusing device 1 is arranged, with respect to the paper transport direction, on the downstream side of a nip between the photosensitive drum 51 and the transfer roller 55. The fusing device 1 heats and presses the paper P having the toner image transferred thereon, and thereby fuses the toner image to the paper P (the details will be given later).

The second transport portion 4*c* transports the paper that has passed through the fusing device 1, and discharges it out of the apparatus. During double-sided printing, a double-sided transport portion 4*d* transports the paper P that is discharged, in a form printed on one side, from the fusing device 1, and feeds it back into the first transport portion 4*b* on the upstream side of the image forming portion 5.

Hardware Configuration of the Multifunctional Peripheral 100

Figure 2:
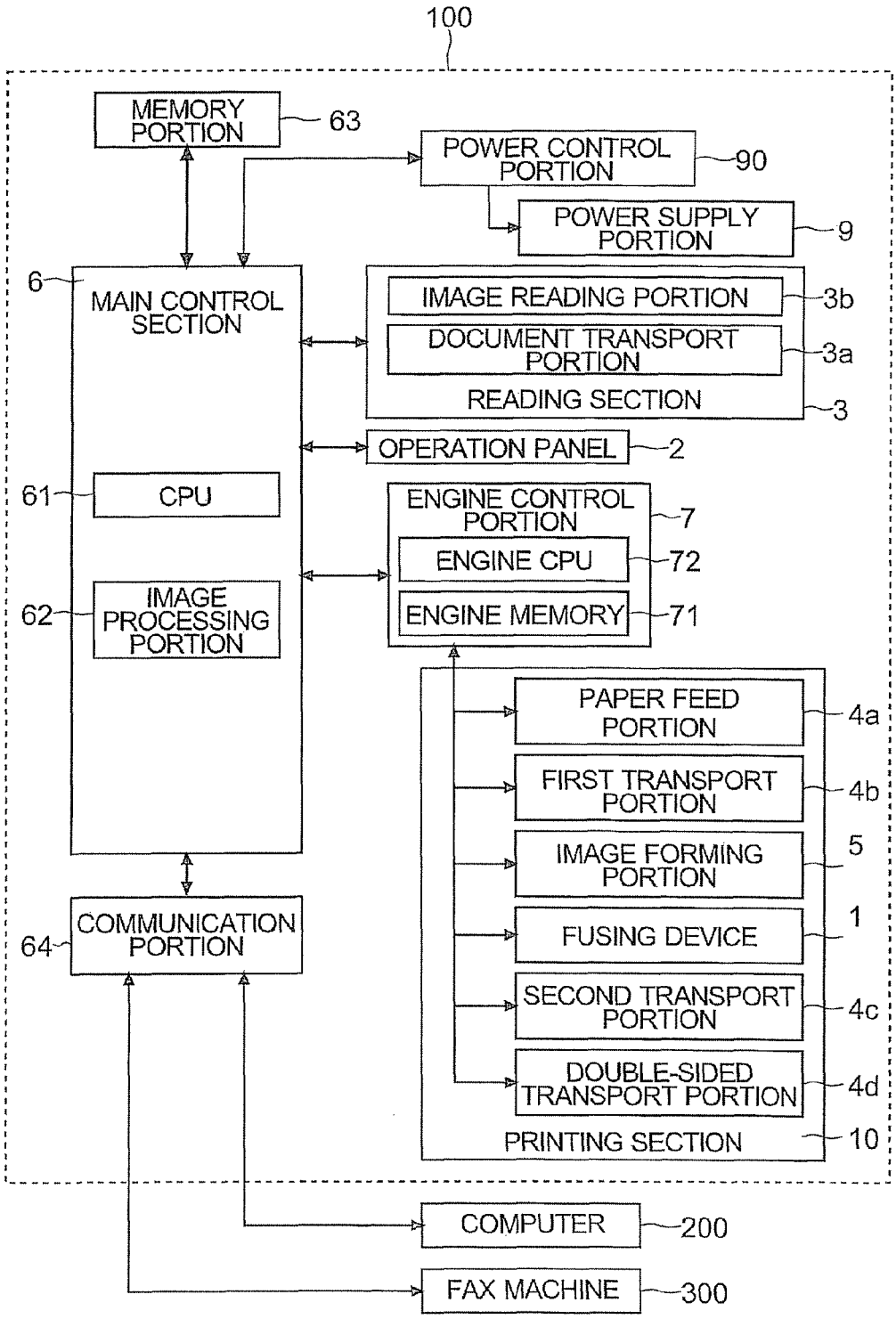
FIG. 2 is a diagram showing a hardware configuration of a multifunctional peripheral.

Next, with reference to FIG. 2, the hardware configuration of the multifunctional peripheral 100 according to the embodiment will be described. FIG. 2 shows the hardware configuration of the multifunctional peripheral 100.

As shown in FIG. 2, the multifunctional peripheral 100 according to the embodiment includes a main control section 6. The main control section 6 controls different parts within the multifunctional peripheral 100. The main control section 6 includes a CPU 61, an image processing portion 62 for generating image data to be used in printing and transmission, and other electronic circuits and devices. The CPU 61 is a central processing unit, and controls different parts within the multifunctional peripheral 100 and performs arithmetic and other operations based on control programs and control data stored in a memory portion 63.

The main control section 6 is connected to an engine control portion 7. The engine control portion 7 (corresponding to a control portion) receives instructions from the main control section 6, and accordingly controls the printing section 10 (paper feed portion 4*a*, first transport portion 4*b*, image forming portion 5, fusing device 1, second transport portion 4*c*, and double-sided transport portion 4*d*) which performs printing involving paper transfer, toner image formation, transferring, and fusing.

The engine control portion 7 includes an engine memory 71 for storing data and programs for controlling parts within the printing section 10. The engine control portion 7 also includes an engine CPU 72 for performing arithmetic operations and other processing to control parts within the printing section 10 based on what is stored in the engine memory 71.

The main control section 6 is also connected to a communication portion 64. The communication portion 64 is an interface for communication with a computer 200, such as a personal computer or a server, and a FAX machine 300. Communication is conducted over a network, a public line, a connection cable, or the like. The communication portion 64 receives printing data including image data and printing settings from the computer 200. The main control section 6 then makes the printing section 10 print based on the printing data (a printer function). The communication portion 64 can also transmit image data resulting from document reading by the reading section 3 to the computer 200 (a transmission function).

The main control section 6 also controls the operation of the reading section 3 including the image reading portion 3*b* and the document transport portion 3*a*. The main control section 6 also controls the operation of, such as display on, the operation panel 2. The main control section 6 further recognizes settings made on the operation panel 2, and recognizes entered jobs, settings, and execution commands.

The Fusing Device 1

Figure 3:
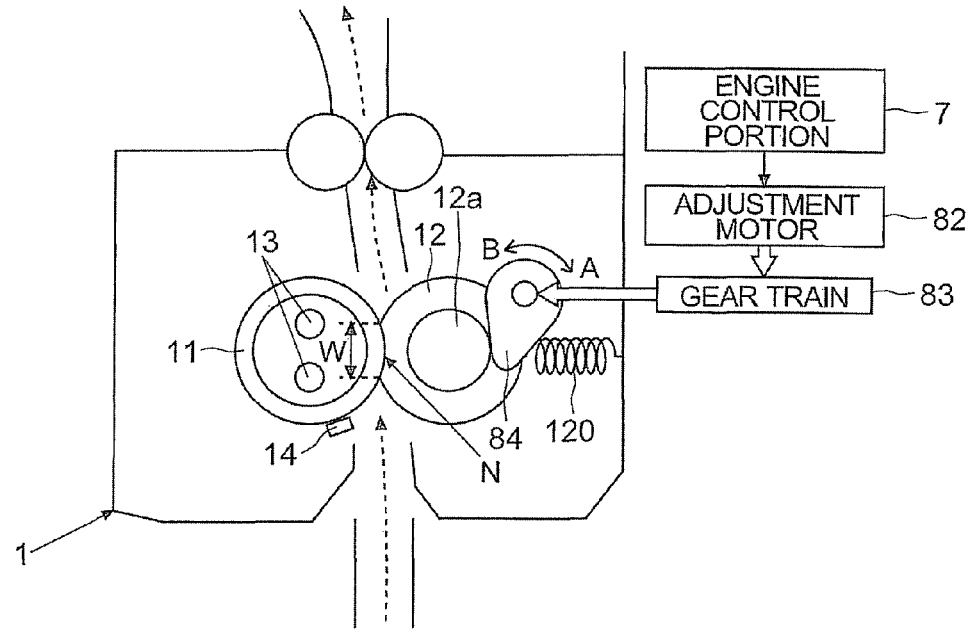
FIG. 3 is a diagram showing a fusing device.

Next, with reference to FIGS. 1 and 3, the fusing device 1 according to the embodiment will be described. FIG. 3 is a diagram showing the fusing device.

As described previously with reference to FIG. 1, the multifunctional peripheral 100 includes a fusing device 1. The fusing device 1 heats and presses a toner image transferred to paper P, and thereby fuses the toner image to the paper. As shown in FIGS. 1 and 3, the fusing device 1 includes a fusing roller 11 (corresponding to a fusing rotary member), which is heated by a heater 13, and a pressing roller 12 (corresponding to a pressing rotary member), which is brought into pressed contact with the fusing roller 11. The fusing roller 11 and the pressing roller 12 are rotatably supported, with their respective axial lines parallel to each other.

The circumferential surface of the fusing roller 11 is shaped like a cylinder or a sleeve. The fusing roller 11 is formed of metal (such as aluminum or iron). The heater 13 is incorporated in the fusing roller 11. In the multifunctional peripheral 100 according to the embodiment, a halogen heater is used as the heater 13. The heater 13 can be of any type so long as it, when energized, can give heat to the fusing roller 11; thus it can instead be a heat source of any other type, such as an IH heater. On the other hand, the pressing roller 12 is a roller having, at its circumferential surface, an elastic layer that deforms to fit the shape of the fusing roller 11. The elastic layer is formed of resin, such as silicone sponge.

Bringing the fusing roller 11 and the pressing roller 12 into pressed contact with each other creates a fusing nip N. Paper P having a toner image transferred thereon passes through the fusing nip N between the fusing roller 11 and the pressing roller 12. Thus, the paper P, along with the toner image transferred to thereto, is heated and pressed. In this way, the toner image is fused to the paper P.

Temperature Control in the Fusing Device 1

Figure 4:
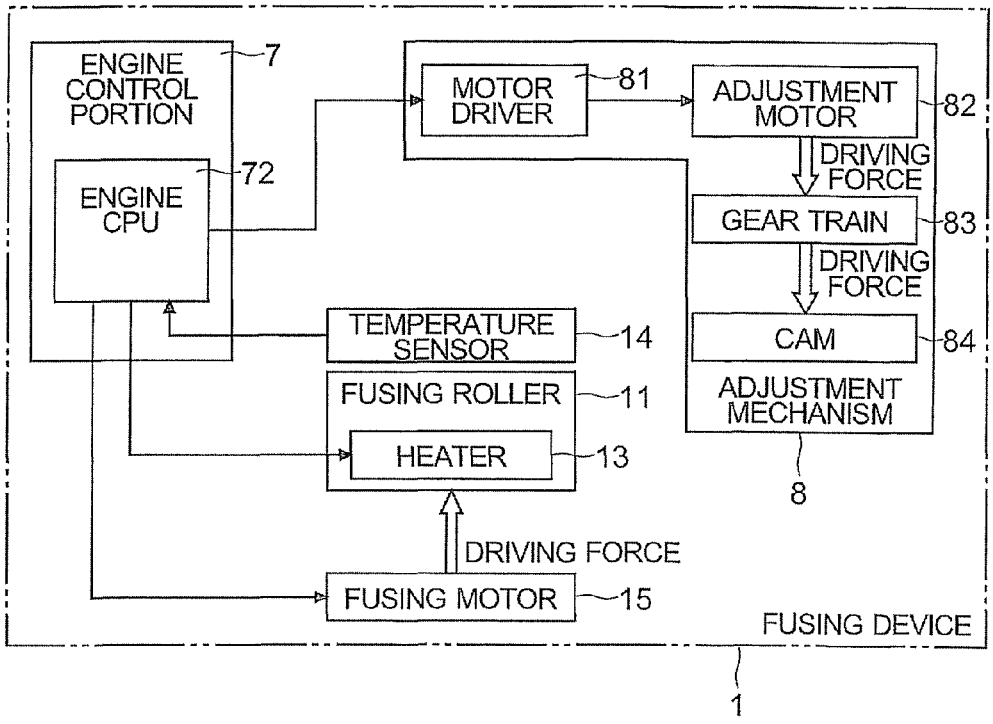
FIG. 4 is a diagram illustrating control in a fusing device.

Next, with reference to FIGS. 3 and 4, temperature control in the fusing device 1 will be described. FIG. 4 is a diagram illustrating control in the fusing device 1.

As shown in FIG. 4, the engine control portion 7 (engine CPU 72) controls energization of the heater 13 (the output of the heater 13).

In the fusing device 1, a temperature sensor 14 (corresponding to a temperature sensing member) is provided in contact with the fusing roller 11 (see FIG. 3). The temperature sensor 14 includes a thermistor, and outputs a voltage whose value varies with the temperature of the fusing roller 11. Based on the output of the temperature sensor 14, the engine control portion 7 recognizes the temperature of the fusing roller 11.

The engine control portion 7 also controls the operation of a fusing motor 15 which drives the fusing roller 11 to rotate. When the heater 13 is energized, as during fusing warm-up operation or during printing, the engine control portion 7 makes the fusing motor 15 rotate to make the fusing roller 11 rotate. When the pressing roller 12 is in pressed contact with the fusing roller 11, as the fusing roller 11 rotates, the pressing roller 12 follows to rotate together. Controlling the fusing device 1 in this way, the engine control portion 7 functions as part of the fusing device 1.

When the main power to the multifunctional peripheral 100 is turned on, or when a recovery is made from a power-save mode to a standard mode, the engine control portion 7 energizes the heater 13 to raise the temperature of the fusing roller 11, now cold, to a preset fusing control temperature, thereby to perform fusing warm-up operation. The multifunctional peripheral according to the embodiment is provided with a main switch 101 for turning on and off the main power (see FIG. 5). The engine control portion 7 energizes the heater 13, and, while monitoring the temperature of the fusing roller 11 based on the output of the temperature sensor 14, checks whether or not the temperature of the fusing roller 11 has reached the fusing control temperature. The fusing control temperature is a temperature adequate to fuse toner, and is set at about 170° C. in the multifunctional peripheral 100 according to the embodiment.

When the temperature of the fusing roller 11 reaches at the fusing control temperature, so long as the standard mode persists before shifting to the power-save mode, the engine control portion 7 keeps the temperature of the fusing roller 11 at the fusing control temperature, thereby to perform temperature keeping control. During temperature keeping control, based on the output of the temperature sensor 14, the engine control portion 7 so operate as to energize the heater 13 when the temperature of the fusing roller 11 drops to or below the fusing control temperature and to stop energizing the heater 13 when the temperature of the fusing roller 11 exceeds the fusing control temperature.

Fusing Pressure Adjustment Mechanism 8

Next, with reference to FIGS. 3 and 4, an adjustment mechanism 8 for adjustment of fusing pressure according to the embodiment will be described.

The fusing device 1 according to the embodiment is provided with an adjustment mechanism 8 which permits the pressing roller 12 to move relative to the fusing roller 11, namely closer to and away from it, for adjustment of fusing pressure. The fusing pressure is the pressure under which the pressing roller 12 is brought into pressed contact with the fusing roller 11 at the fusing nip N. Although, in the embodiment, an example is dealt with where the pressing roller 12 is moved for adjustment of the fusing pressure, it is also possible to move the fusing roller 11 for adjustment of the fusing pressure; it is as well possible to move both the fusing roller 11 and the pressing roller 12 for adjustment of the fusing pressure.

Adjusting the fusing pressure causes the nip width W of the fusing nip N to vary. In other words, the adjustment mechanism 8 can change the nip width W of the fusing nip N. The nip width W of the fusing nip N is the width over which the fusing roller 11 and the pressing roller 12 makes contact with each other in the paper transport direction. The higher the fusing pressure, the more the pressing roller 12 is pressed against the fusing roller 11, and thus the greater the nip width W. The lower the fusing pressure, the smaller the nip width W owing to the elasticity of the pressing roller 12. To allow the pressing roller 12 to move quickly away from the fusing roller 11 on reduction of the fusing pressure (to allow the nip width W to change quickly), a biasing member 120 can be provided which biases the pressing roller 12 in the direction away from the fusing roller 11.

As shown in FIGS. 3 and 4, the adjustment mechanism 8 includes a motor driver 81, an adjustment motor 82, a gear train 83, and a cam 84. Based on a driving force generated by the adjustment motor 82, the adjustment mechanism 8 makes the cam 84 rotate to make the pressing roller 12 move.

The adjustment motor 82 is a motor that can rotate in forward and reverse directions. As the adjustment motor 82, a motor such as a DC brushless motor can be used. The motor driver 81 is provided in the fusing device 1 for the purpose of controlling the voltage applied, and the direction of the electric current passed, across the terminals of the adjustment motor 82 and thereby controlling the rotation direction, rotation speed, and rotation duration of the adjustment motor 82. The motor driver 81 makes the adjustment motor 82 rotate in the direction dictated by instructions from the engine control portion 7 (engine CPU 72).

The adjustment mechanism 8 also includes the cam 84, which makes contact with the rotary shaft 12*a* of the pressing roller 12, and the gear train 83, which is composed of a plurality of gears. When the adjustment motor 82 is rotated, a driving force is transmitted via the gear train 83 to the cam 84. This causes the cam 84 to rotate. As the cam 84 rotates, the rotary shaft 12*a* of the pressing roller 12 moves. In this way, by rotating the adjustment motor 82, the gear train 83, and the cam 84, it is possible to change the position of the rotary shaft 12*a* of the pressing roller 12, and thereby to adjust the fusing pressure.

When the adjustment motor 82 is so rotated that the cam 84 rotates in the direction indicated by arrow A in FIG. 3, the cam 84 makes the rotary shaft 12*a* move (the former pushes the latter) toward the fusing roller 11. This increases the fusing pressure, and increases the nip width W. By contrast, when the adjustment motor 82 is so rotated that the cam 84 rotates in the direction indicated by arrow B in FIG. 3, the force with which the pressing roller 12*a* is pushed toward the fusing roller 11 is reduced, and thus the pressing roller 12, owing to its elasticity, moves away from the fusing roller 11. In other words, the pressing roller 12 retracts in the direction in which the fusing pressure decreases.

Although, in the embodiment, an example is dealt with where the fusing pressure is adjusted by use of the adjustment motor 82, the gear train 83, and the cam 84, it is also possible to adopt any other configuration for the adjustment mechanism 8. It is possible to use a solenoid as the adjustment mechanism 8, in which case the solenoid applies a force to the rotary shaft 12*a* of the pressing roller 12 and, by varying the force with which the pressing roller 12 pushes the fusing roller 11, the fusing pressure is adjusted. It is also possible to configure the adjustment mechanism 8 so as to adjust the fusing pressure, instead of by applying a force to the rotary shaft 12*a*, by moving a frame supporting the rotary shaft 12*a* and thereby varying the force with which the pressing roller 12 pushes the fusing roller 11.

Standard Mode and Power-Save Mode

Figure 5:
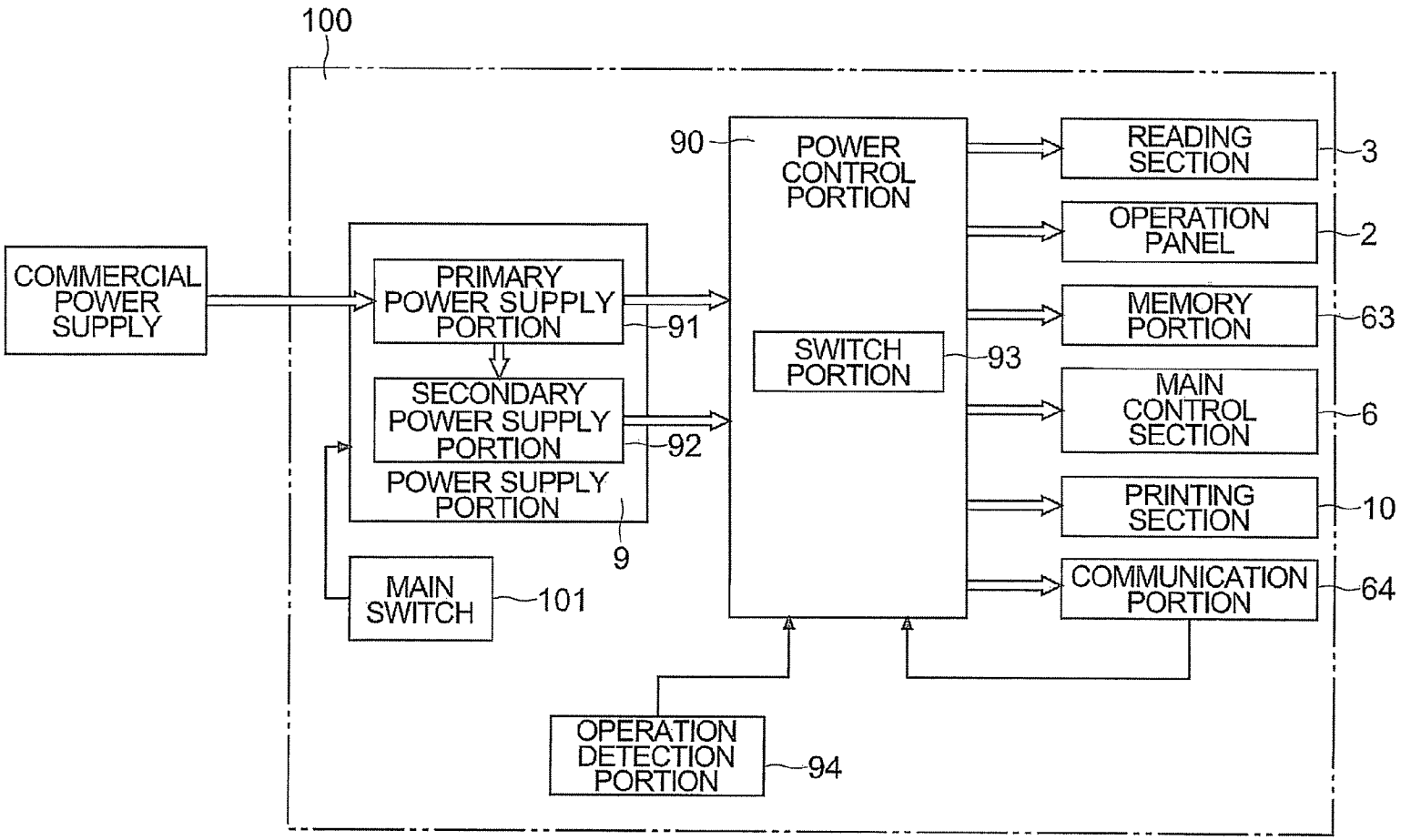
FIG. 5 is a diagram illustrating a standard mode and a power-save mode.

In the fusing device 1 (multifunctional peripheral 100) according to the embodiment, the fusing pressure is adjusted during fusing warm-up operation which is performed when the main power is turned on or when a recovery is made from a power-save mode to a standard mode, or during printing after fusing warm-up operation. Thus, a description will now be given of the power-save mode and the standard mode with reference to FIG. 5. FIG. 5 is a diagram illustrating the power-save mode and the standard mode.

The standard mode is a mode in which electric power is supplied to all parts of the multifunctional peripheral 100, which is thus kept in a state ready to execute jobs such as copying, scanning, and transmission. In standard mode, electric power is kept supplied to the heater 13 to maintain the temperature of the fusing roller 11. Thus, even when no job is being executed, that is, even in a stand-by state, a given amount of electric power is constantly consumed. To avoid this, the multifunctional peripheral 100 according to the embodiment can operate in a power-save mode, in which it operates with lower electric power consumption than in standard mode. In power-save mode, the supply of electric power to preset parts within the multifunctional peripheral 100 is stopped.

As shown in FIGS. 2 and 5, the multifunctional peripheral 100 is provided with a power supply portion 9. The power supply portion 9 is connected to a commercial electric power supply, and includes, as a power conversion circuit for converting alternating-current power to direct-current power, like a converter, a regulator, or a switching power supply, a primary power supply portion 91 and a secondary power supply portion 92. The primary power supply portion 91 generates voltages needed to drive different motors etc. The secondary power supply portion 92 generates voltages to be supplied to different circuits within the multifunctional peripheral 100.

The multifunctional peripheral 100 is further provided with a power control portion 90 for controlling the supply of electric power to different parts within the multifunctional peripheral 100. The power control portion 90 has a switch portion 93 which includes a plurality of switching devices for turning on and off the supply of electric power. The switch portion 93 permits the supply of electric power to the reading section 3, the operation panel 2, the memory portion 63, the main control section 6, the printing section 10, and the communication portion 64 to be turned on and off.

When the main switch 101 is so operated as to turn the main power on, the multifunctional peripheral 100 first operates in standard mode. In standard mode, the power control portion 90 supplies electric power to all parts within the multifunctional peripheral 100, such as the reading section 3, operation panel 2, memory portion 63, main control section 6, printing section 10, and communication portion 64.

When a preset condition is fulfilled, the multifunctional peripheral 100 shifts from standard mode to power-save mode. Conditions for shifting can be determined arbitrarily. Specifically, as conditions for shifting, when the operation panel 2 accepts a command for shifting to power-save mode, or when a preset period has elapsed with no job being executed or with no operation made on the multifunctional peripheral 100, that is with the multifunctional peripheral 100 in a stand-by state, the main control section 6 and the power control portion 90 recognizes that a condition for shifting is fulfilled.

When a shift is made to power-save mode, the power control portion 90 stops supplying electric power to preset parts. In the multifunctional peripheral 100 according to the embodiment, in power-save mode, the power control portion 90 stops supplying electric power to the reading section 3 and the printing section 10. The power control portion 90 continues supplying electric power to part of the circuits within the main control section 6, the memory portion 63, and the operation panel 2 that need to be operating in power-save mode. The power control portion 90 continues supplying electric power to the communication portion 64 even in power-save mode.

When a preset condition for recovery is fulfilled, the multifunctional peripheral 100 recovers from power-save mode to standard mode. Conditions for recovery can be determined arbitrarily. Specifically, when operation on or input to the multifunctional peripheral 100 is detected by an operation detection portion 94, this is taken as a condition for recovery. Even in power-save mode, electric power is kept supplied to the operation detection portion 94.

In the multifunctional peripheral 100 according to the embodiment, as the operation detection portion 94, there are provided a load/unload sensor S1 which detects whether the paper feed portion 4*a* is loaded or unloaded, a cover open/close sensor S2 which detects whether a cover 102 of the multifunctional peripheral 100 is open or closed, a document placement sensor S3 which detects whether or not a document is placed on the document transport portion 3*a* (document tray 33), and an open/close sensor S4 (see FIG. 1) which detects whether or not the document transport portion 3*a* is in a lifted or a settled position. The communication portion 64 can also be used as the operation detection portion 94. In that case, receipt of data requesting printing is taken as fulfillment of a condition for recovery. The operation panel 2 can also be used as the operation detection portion 94. In that case, when any key on the operation panel 2 is touched, this is taken as fulfillment of a condition for recovery.

Adjustment of the Fusing Pressure

Next, with reference to FIGS. 6A to 6D, adjustment of the fusing pressure in the multifunctional peripheral 100 according to the embodiment will be described. FIGS. 6A to 6D are diagrams illustrating a flow of adjustment of the fusing pressure.

The engine control portion 7 controls the adjustment mechanism 8 such that, in fusing warm-up operation and a printing job after fusing warm-up operation, the fusing pressure at the fusing nip N is changed. Specifically, the engine control portion 7 controls the adjustment mechanism 8 such that, during fusing warm-up operation, the fusing pressure is at a first set value; during printing of the first page after completion of fusing warm-up operation, the fusing pressure is at a third set value; and during printing of the second and following pages after completion of fusing warm-up operation, the fusing pressure is at a second set value.

The different values of the fusing pressure have the relationship:

Third set value>Second set value>First set value

First, the first set value in fusing pressure adjustment will be described. When the main power is off, or in power-save mode, no electric power is supplied to the heater 13. Even if the fusing roller 11 is hot, so long as the main power remains off or power-save mode remains in effect, the temperature of the fusing roller 11 gradually falls until the temperature of the fusing roller 11 is about equal to room temperature.

When the main power is turned on, or when a recovery is made from power-save mode to standard mode, the engine control portion 7 heats the fusing roller 11 up to the fusing control temperature adequate for fusing of a toner image (fusing warm-up operation). When the temperature of the fusing roller 11 has fallen down to about room temperature, of all the different kinds of operation performed when the main power is turned on or a recovery is made to standard mode, fusing warm-up operation is most likely to take the longest time. Thus, by reducing the time required for fusing warm-up operation, it is possible to reduce the first print time.

By reducing the heat that escapes (conducts) from the fusing roller 11 to the pressing roller 12, it is possible to reduce the time that it takes for the temperature of the fusing roller 11 to reach the fusing control temperature. Accordingly, the engine control portion 7 controls the adjustment mechanism 8 such that the fusing pressure is at the first set value, that is, a fusing pressure smaller than the second and third set values. Thus, during fusing warm-up operation, the nip width W is small. Thus, less heat is lost, than during printing, via the part of the fusing roller 11 in contact with the pressing roller 12, and thus the temperature of the fusing roller 11 can be raised quickly.

Figure 6A:
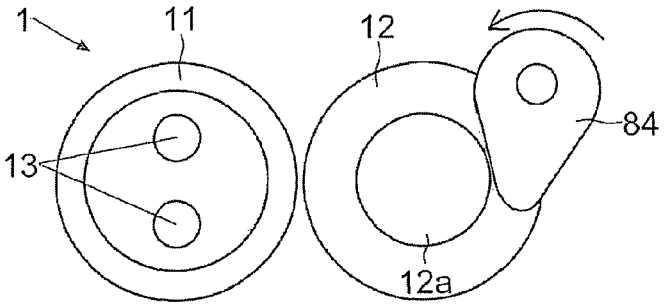
FIGS. 6A to 6D are diagrams illustrating a flow of fusing pressure adjustment.

FIG. 6A shows the state of the pressing roller 12 and the fusing roller 11 during fusing warm-up operation. As shown there, during fusing warm-up operation, to prevent the heat of the fusing roller 11 from being absorbed by the pressing roller 12, the engine control portion 7 keeps the fusing pressure low or equal to 0, and keeps the nip width W of the fusing nip N small or equal to 0.

In the fusing device 1 according to the embodiment, during fusing warm-up operation, the engine control portion 7 controls the adjustment mechanism 8 such that the fusing roller 11 and the pressing roller 12 are out of contact with each other. Here, the fusing roller 11 and the pressing roller 12 do not necessarily have to be out of contact with each other. The engine control portion 7 can instead control the adjustment mechanism 8 such as to minimize the fusing pressure without achieving a non-contact state.

After the temperature of the fusing roller 11 has risen to reach the fusing control temperature (after completion of fusing warm-up operation), during a printing job that is executed before a shift is made to power-save mode, a sufficient pressure is applied to allow fusing of a toner image to paper P. Accordingly, the fusing pressure needs to be equal to or higher than a predetermined pressure. A printing job is, for example, a copying job, or a job as a printer based on data from the computer 200.

Here, on completion of fusing warm-up operation, the temperature of the fusing roller 11 has reached the fusing control temperature. However, the temperature of the pressing roller 12 is still lower than that of the fusing roller 11. When the adjustment mechanism 8 moves the rotary shaft 12*a* of the pressing roller 12 to set the fusing pressure back at a given pressure, the pressing roller 12 may not be hot enough, and may absorb heat from the fusing roller 11, causing defective fusing.

To avoid that, before printing of the first page (page one) after completion of fusing warm-up operation, the engine control portion 7 makes the adjustment mechanism 8 move the pressing roller 12 such that the fusing pressure is at the third set value. In other words, after completion of fusing warm-up operation, the engine control portion 7 lets a sheet of paper P for the first page pass through the fusing nip N with the fusing pressure set at the third set value. The fusing pressure of the third set value is higher than the fusing pressure of the second set value corresponding to the fusing pressure when the pressing roller 12 is hot, and preset as a designed value. Thus, the sheet of paper P for the first page after completion of fusing warm-up operation passes through the fusing nip N with a wider nip width W than when the fusing pressure is set at the second set value.

Figure 6B:
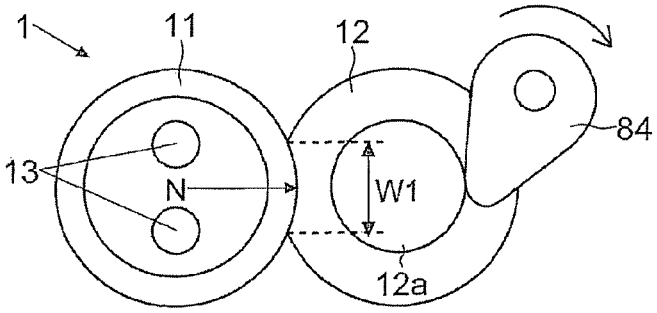
Figure 6C:
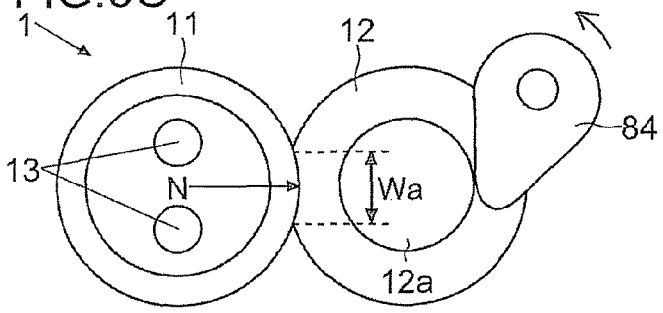
Figure 6D:
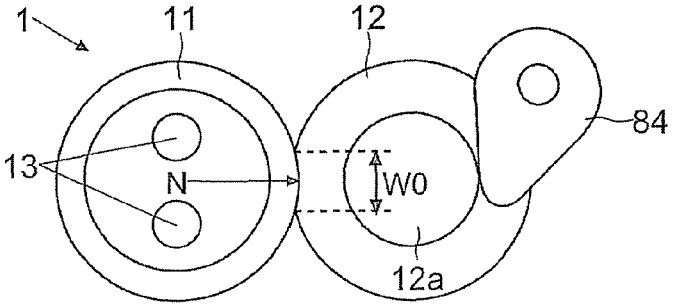

In FIG. 6D, the nip width W of the fusing nip N with the second set value is indicated by W0. In FIG. 6B, the nip width W of the fusing nip N with the third set value is indicated by W1.

With a wider nip width W of the fusing nip N, the pressure against paper P is higher than usual. It thus takes longer time for paper P to pass through the fusing nip N than usual. As a result, even when the temperature of the fusing roller 11 drops under the influence of the pressing roller 12, the toner image can be heated and pressed sufficiently. This permits the toner image to be firmly fused to the paper P.

However, the higher the fusing pressure is, the heavier the load on the fusing motor 15, and the stronger the forces is, that act on the gears that rotate the fusing roller 11 and the pressing roller 12. Moreover, if paper P jams at the fusing nip N, it is more difficult to remove it. Moreover, a high fusing pressure may make it difficult for the deformed pressing roller 12 to restore its original shape.

To avoid those inconveniences, as shown in FIGS. 6C and 6D, for the second and following pages after completion of fusing warm-up operation, the engine control portion 7 makes the adjustment mechanism 8 move the pressing roller 12 such that the fusing pressure is at the second set value. In other words, after completion of fusing warm-up operation, in a sheet-to-sheet interval before a preset one of the second and following pages enters the fusing nip N, the engine control portion 7 sets the fusing pressure back at the preset second set value. The engine control portion 7 thus, with the fusing pressure set back at the second set value, passes the sheet of paper P for the preset page through the fusing nip N. The second set value is an ordinary fusing pressure that is preset to be adequate as a designed value. This helps prevent inconveniences resulting from an excessively high fusing pressure.

Specifically, in the fusing device 1 according to the embodiment, each time a sheet of paper P passes through the fusing device 1, the engine control portion 7 makes the adjustment mechanism 8 reduce the fusing pressure one step. Here, let a preset number of pages be n. Then, after the sheet of paper P for the (n−1)th page after completion of fusing warm-up operation has passed through the fusing nip N, before the sheet of paper P for the nth page enters the fusing nip N, the engine control portion 7 makes the adjustment mechanism 8 adjust the fusing pressure such that the fusing pressure is at the second set value. In this way, the engine control portion 7 reduces, during sheet-to-sheet intervals, the fusing pressure stepwise until it equals the second set value. As shown in FIGS. 6A to 6D, the nip width W of the fusing nip N becomes gradually smaller from W1 to Wa to W0, the nip width W becomes the nip width W0 of the second set value. Thus, even with sheets of paper P for the second and following pages after completion of fusing warm-up operation, it is possible to prevent defective fusing resulting from the heat of the fusing roller 11 being absorbed by the pressing roller 12.

The preset number of pages can be determined arbitrarily with consideration given to the slope at which the temperature of the pressing roller 12 rises. The preset number of pages can be 3 to about 10. Since paper P of larger sizes takes longer time to pass through the fusing nip N, the preset number of pages can be determined according to the size of the paper P used in printing. In that case, the larger the size of paper is, the smaller the preset number of pages is made, and the smaller the size of paper is, the greater the preset number of pages is made.

Although in the embodiment, an example is dealt with where the fusing pressure is changed in sheet-to-sheet intervals, the fusing pressure can instead be changed while paper P is passing through the fusing nip N.

Here, the paper transport speed is fixed, and the distance from the paper feed portion 4*a* to the fusing nip N is fixed. Thus, the engine control portion 7 can, by counting the time after the start of paper feeding, recognize the time point that a sheet of paper P starts to enter the fusing nip N and the time point that a sheet of paper P completely passes through the fusing nip N. When the fusing pressure is changed, paper feeding from the paper feed portion 4*a*, image formation, and transferring can be started at time points later than usual to lengthen the sheet-to-sheet intervals.

When the fusing pressure reaches the second set value, the engine control portion 7 then, at least so long as standard mode persists, makes the adjustment mechanism 8 keep the fusing pressure at the second set value so that the nip width W of the fusing nip N is kept equal to the ordinary nip width W0.

Flow of Fusing Pressure Adjustment

Figure 7:
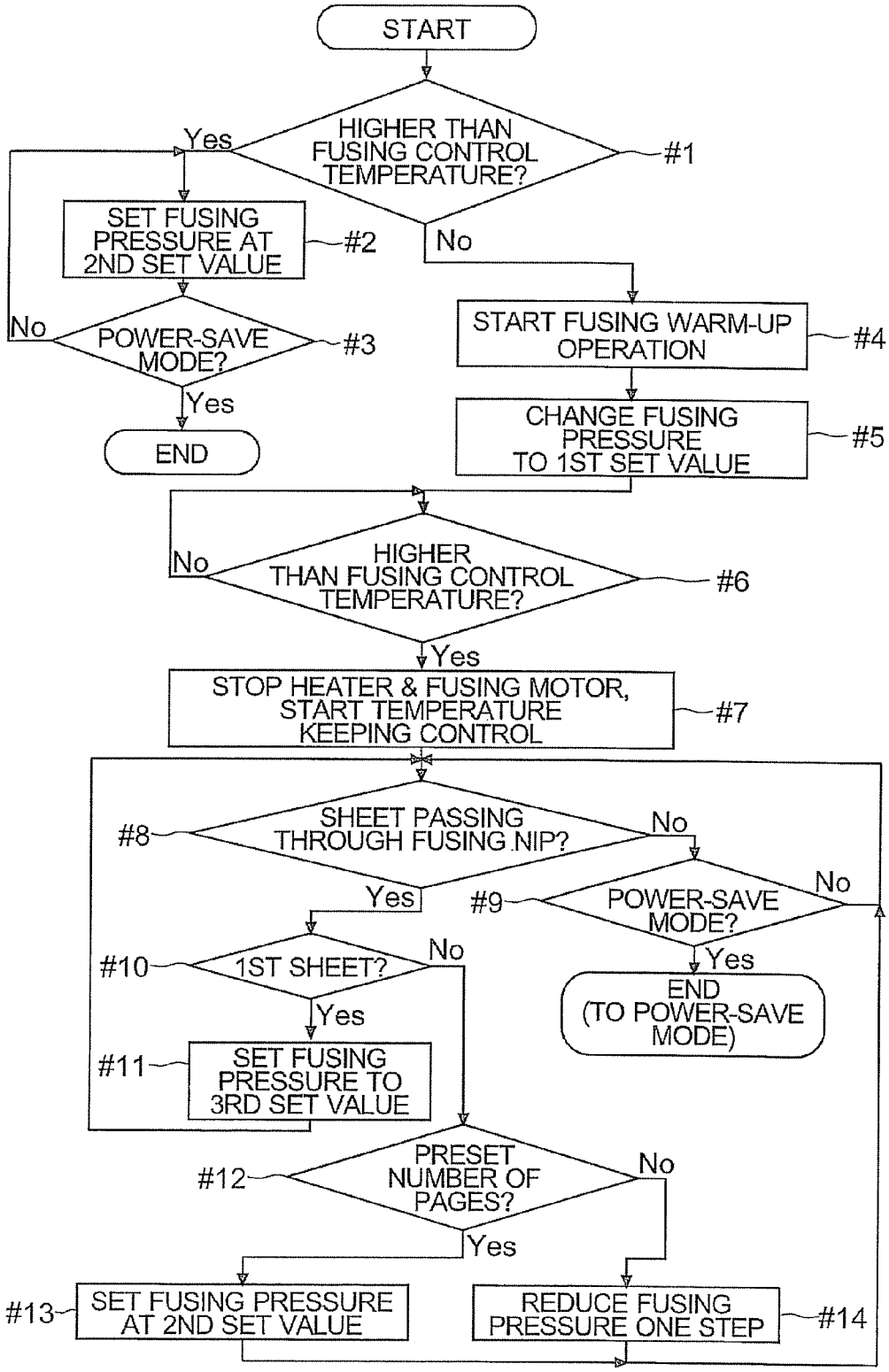
FIG. 7 is a flow chart showing a flow of fusing pressure adjustment.

Next, with reference to FIG. 7, the flow of fusing pressure adjustment in the fusing device 1 according to the embodiment will be described. FIG. 7 is a flow chart showing the flow of fusing pressure adjustment.

The flow of FIG. 7 starts when the main power is turned on or when a recovery is made from power-save mode to standard mode, that is, at the time point that fusing warm-up operation is about to be started.

First, based on the output of the temperature sensor 14, the engine control portion 7 checks whether or not the temperature of the fusing roller 11 is equal to or higher than the fusing control temperature (step #1). This is done to exclude cases where the main power is turned on and off as a means of resetting.

If the temperature of the fusing roller 11 is equal to or higher than the fusing control temperature (step #1, "Yes"), the fusing roller 11 and the pressing roller 12 are considered sufficiently hot, and thus the engine control portion 7 makes the adjustment mechanism 8 adjust the fusing pressure at the second set value (step #2). Then, the engine control portion 7 checks whether or not a condition for shifting into power-save mode is fulfilled (step #3). If a condition for shifting into power-save mode is fulfilled (step #3, "Yes"), the supply of electric power to preset parts within the multifunctional peripheral 100, such as the fusing device 1, is stopped, power-save mode comes into effect, and the flow ends ("END"). By contrast, if no condition for shifting into power-save mode is fulfilled (step #3, "No"), the flow returns to step #2.

On the other hand, if the temperature of the fusing roller 11 is lower than the fusing control temperature (step #1, "No"), the engine control portion 7 starts fusing warm-up operation (step #4). When starting fusing warm-up operation, the engine control portion 7 starts to supply electric power to the heater 13, makes the fusing motor 15 rotate, and thereby makes the fusing roller 11 and the pressing roller 12 rotate.

When starting fusing warm-up operation, the engine control portion 7 controls the adjustment mechanism 8 to set the fusing pressure at the first set value (step #5, FIG. 6A).

Then, the engine control portion 7 checks whether or not the temperature is equal to or higher than the fusing control temperature (Step #6). The engine control portion 7 repeats this check until the temperature of the fusing roller 11 reaches the fusing control temperature (step #6 "No," then a return to step #6). When the temperature is equal to or higher than the fusing control temperature (step #6, "Yes"), the engine control portion 7 stops energizing the heater 13, makes the fusing motor 15 stop, and starts temperature keeping control (step #7).

The engine control portion 7 then checks whether or not there is any sheet of paper P about to be passed through the fusing nip N (step #8). In other words, the engine control portion 7 checks whether or not there is any printing job to be executed.

If there is no sheet of paper P about to be passed through the fusing nip N (step #8, "No"), the engine control portion 7 checks whether or not a condition for shifting into power-save mode is fulfilled (step #9). If a condition for shifting into power-save mode is fulfilled (step #9, "Yes"), the supply of electric power to preset parts within the multifunctional peripheral 100, such as the fusing device 1, is stopped, power-save mode thus comes into effect, and the flow ends ("END"). By contrast, if no condition for shifting into power-save mode is fulfilled (step #9, "No"), the flow returns to step #8.

On the other hand, if a sheet of paper P is about to be passed through the fusing nip N for a printing job (step #8, "Yes"), the engine control portion 7 checks whether or not the sheet of paper P that is about to be passed through the fusing nip N is the sheet of paper P for the first page to be passed through the fusing nip N after completion of fusing warm-up operation (Step #10).

If the sheet of paper P is recognized to be the one for the first page (step #10, "Yes"), the engine control portion 7 controls the adjustment mechanism 8 to set the fusing pressure at the third set value before the sheet of paper P for the first page starts to pass through the fusing nip N (Step #11). Thus, the sheet of paper P for the first page passes through the fusing nip N with the fusing pressure at the third set value. Then, the flow returns to step #8.

By contrast, if the sheet of paper P is not recognized to be the one for the first page (step #10, "No"), it is checked whether or not the sheet of paper P now about to be passed through the fusing nip N is the one that corresponds to the preset number of pages or more after completion of fusing warm-up operation (step #12).

If the sheet of paper P now about to be passed through the fusing nip N is the one that corresponds to the preset number of pages or more as counted after completion of fusing warm-up operation (step #12, "Yes"), the engine control portion 7 controls the adjustment mechanism 8 to set the fusing pressure at the second set value before that sheet of paper P starts to pass through the fusing nip N (step #13). For any page that exceeds the preset number of pages, the engine control portion 7 makes the adjustment mechanism 8 keep the fusing pressure at the second set value. Then, the flow returns to step #8.

On the other hand, if the sheet of paper P now about to be passed through the fusing nip N is one that correspond to less than the preset number of pages as counted after completion of fusing warm-up operation (step #12, "No"), the engine control portion 7 makes the adjustment mechanism 8 reduce the fusing pressure one step after the previous sheet of paper P has passed through the fusing nip N before the sheet of paper P now about to be passed through the fusing nip N (step #14) starts to pass through it. The fusing pressure here at step #14 is higher than the second set value but lower than the fusing pressure under which the previous sheet of paper P has passed through the fusing nip N. Then the flow returns to step #8.

Modified Example

Figure 8A:
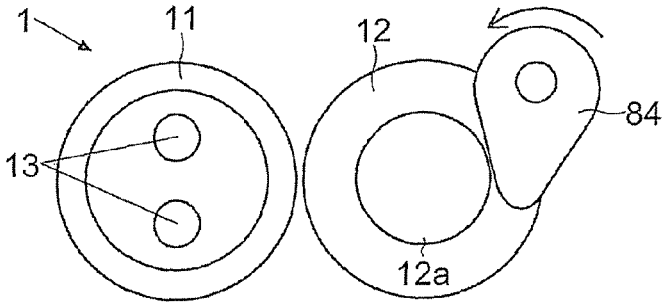
FIGS. 8A to 8C are diagrams illustrating a flow of fusing pressure adjustment in a modified example.
Figure 8B:
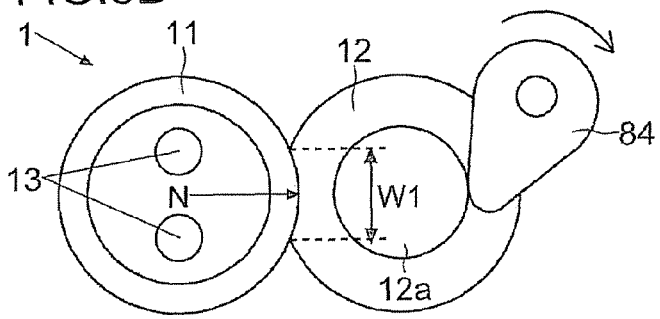
Figure 8C:
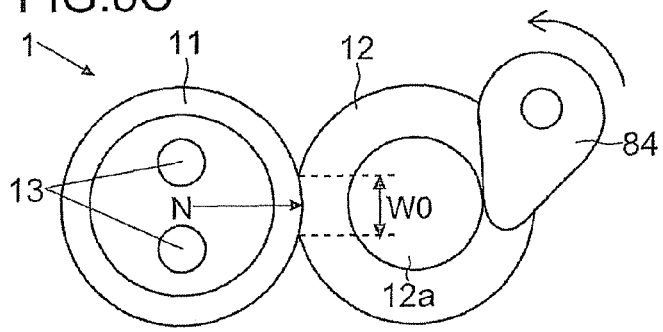

Next, with reference to FIGS. 8A to 8C, a modified example will be described. FIGS. 8A to 8C are a diagram illustrating the flow of fusing pressure adjustment in the modified example.

In the embodiment described above, an example is dealt with where the fusing pressure is first set at the third set value and is then reduced stepwise. Specifically, after completion of fusing warm-up operation, the fusing pressure is set back at the second set value when the sheet of paper P for one of the third and following pages is about to be passed through the fusing nip N.

In this modified example, after completion of fusing warm-up operation, the sheet of paper P for the first page is passed through the fusing nip N with the fusing pressure at the third set value. Thus far, what takes place is the same as in the embodiment described above. However, in this modified example, the sheet of paper P for the second page is passed through the fusing nip N with the fusing pressure at the second set value. This differs from what has been previously described. In other words, the engine control portion 7, instead of adjusting the fusing pressure in a plurality of steps from the third set value to the second set value, controls the adjustment mechanism 8 to set the fusing pressure at the second set value before the sheet of paper P for the second page enters the fusing nip N.

Details will now be given with reference to FIGS. 8A to 8C. FIG. 8A is a diagram showing a state of the fusing device 1 during fusing warm-up operation. This state is the same as in the embodiment described previously.

FIG. 8B is a diagram showing a state of the fusing device 1 with the fusing pressure at the third set value. The state shown in FIG. 8B is a state where, after completion of fusing warm-up operation, the fusing pressure is set at the third set value, and is the same as in the embodiment described previously.

FIG. 8C shows a state where, after completion of fusing warm-up operation, after passage of the sheet of paper for the first page before passage of the sheet of paper for the second page, the engine control portion 7 has made the adjustment mechanism 8 set the fusing pressure at the second set value (set it back at the second set value). In this way, instead of the fusing pressure being changed from the third set value to the second set value stepwise over a plurality of sheets of paper, the fusing pressure set at the third set value can be changed back to the second set value in a single page-to-page interval.

As to the flow of fusing pressure adjustment here, the flow chart in FIG. 6 and its description apply equally to this modified example except the parts directed to steps #12 and #14.

As described above, according to the present disclosure, a fusing device includes: a heater 13 which generates heat when energized; a fusing rotary member (fusing roller 11) which is heated by the heat from the heater 13; a pressing rotary member (pressing roller 12) which is in pressed contact with the fusing rotary member so as to form a fusing nip N through which paper P having a toner image transferred thereto is passed to fuse the toner image to the paper; an adjustment mechanism 8 which adjusts the fusing pressure under which the fusing rotary member and the pressing rotary member are in contact with each other at the fusing nip N, thereby to adjust the nip width W of the fusing nip N; a temperature sensing member (temperature sensor 14) which senses the temperature of the fusing rotary member; and a control portion (engine control portion 7) which recognizes the temperature of the fusing rotary member based on the output from the temperature sensing member. The control portion (engine control portion 7) controls the adjustment mechanism 8, and, when the temperature of the fusing rotary member is lower than a fusing control temperature adequate for fusing of the toner image, energizes the heater 13 to raise the temperature of the fusing rotary member up to the fusing control temperature, thereby to perform fusing warm-up operation. Moreover, the control portion controls the adjustment mechanism such that, during the fusing warm-up operation, the fusing pressure is at a preset first set value; then with the fusing pressure at a preset third set value, a first sheet of paper P after completion of the fusing warm-up operation is passed through the fusing nip N; and the fusing pressure is changed to a preset second set value before sheets of paper for a preset number of pages pass through the fusing nip (for one of a second and following pages) after completion of the fusing warm-up operation. Here, of the first, second, and third set values, the third set value is greatest, the second set value is second greatest, and the first set value is smallest.

With this configuration, during fusing warm-up operation, the fusing pressure is held lower, the width of the fusing nip N (as measured in the paper transport direction) is held smaller, and thus the contact area between the fusing rotary member (fusing roller 11) and the pressing rotary member (pressing roller 12) is smaller. This makes it more difficult for the heat of the fusing rotary member to be absorbed by the pressing rotary member, and helps the temperature of the fusing rotary member reach the fusing control temperature quickly, contributing to a shorter first print time than ever.

Moreover, after completion of fusing warm-up operation, during printing for the first page, the fusing pressure is raised up to the third set value so that the nip width W is larger than usual. Thus, the toner image is heated for a time longer than usual, and the fusing pressure is higher than usual. This prevents defective fusing on the first sheet of paper P to be passed through the fusing nip N after completion of fusing warm-up operation.

Furthermore, the thus momentarily increased fusing pressure is set back at the ordinary fusing pressure level (the second set value) before sheets of paper for a preset number of sheets pass the fusing nip (with one of the second and following pages) after completion of fusing warm-up operation. By setting the fusing pressure back at its ordinary pressure, it is possible to reduce the torques required to rotate, and hence the loads on, the fusing rotary member (fusing roller 11) and the pressing rotary member (pressing roller 12), and to prevent damage to parts within the fusing device 1 related to driving and to the fusing rotary member and the pressing rotary member themselves. Moreover, a state with a high fusing pressure then does not persist, allowing easy passage of paper P through the fusing nip N.

Preferably, the preset page is one of the third and following pages after completion of fusing warm-up operation, and the control portion (engine control portion 7) operates such that the fusing pressure is set at the preset second set value before the preset page enters the fusing nip N after completion of the fusing warm-up operation, and that the fusing pressure is reduced from the third set value gradually, each time a sheet of paper P passes through the fusing nip N. This helps prevent, even with the second and following pages, defective fusing resulting from the heat of the fusing rotary member (fusing roller 11) being absorbed by the pressing rotary member (pressing roller 12). In this way, it is possible to change the fusing pressure back to the ordinary pressure so that fusing is performed satisfactorily on the second and following pages after completion of fusing warm-up operation, with consideration given to the tendency of the pressing rotary member to become hotter by receiving heat from the fusing rotary member.

Preferably, the control portion (engine control portion 7) controls the adjustment mechanism 8 such that the fusing pressure is set at the second set value after the sheet of paper P for the first page has passed through the fusing nip N before the sheet of paper P for the second page enters the fusing nip N. In this case, the preset page is the second page after completion of fusing warm-up operation. It is thus possible to perform fusing in the fusing device 1 back in the ordinary state quickly, while preventing defective fusing. It is also possible to minimize inconveniences of a high fusing pressure.

Preferably, when the fusing pressure is at the first set value, the control portion (engine control portion 7) controls the adjustment mechanism 8 such that the fusing rotary member (fusing roller 11) and the pressing rotary member (pressing roller 12) are kept out of contact with each other. Thus, during fusing warm-up operation, no heat conducts, by contract, from the pressing rotary member to the fusing rotary member. Thus, it is possible to heat the fusing rotary member quickly, and to raise the temperature of the fusing rotary member up to the fusing control temperature quickly.

Preferably, before starting fusing warm-up operation, the control portion (engine control portion 7) checks whether or not the temperature of the fusing rotary member (fusing roller 11) is equal to or higher than the fusing control temperature so that, when the temperature of the fusing rotary member is equal to or higher than the fusing control temperature, the control portion controls the adjustment mechanism 8 such that the fusing pressure is at the second set value without setting it at the first or third set value. In other words, the control portion controls the adjustment mechanism 8 such that the fusing pressure is at the second set value. Thus, when the fusing roller 11 and the pressing roller 12 are considered to be sufficiently hot, paper can be passed under the ordinary fusing pressure. It is also possible to omit unnecessary adjustment of the fusing pressure, and thus to make the image forming apparatus ready for use quickly.

An image forming apparatus (multifunctional peripheral 100) includes a fusing device 1 as described above. Thus, it is possible to provide an image forming apparatus that requires less time for fusing warm-up operation and has a shorter first print time. It is also possible to provide an image forming apparatus free from defective fusing starting with the sheet of paper P for the first page.

The above embodiments of the present disclosure as well as the appended claims and figures show multiple characterizing features of the invention in specific combinations. The skilled person will easily be able to consider further combinations or sub-combinations of these features in order to adapt the invention as defined in the claims to his specific needs.

What is claimed is:

1. A fusing device comprising:

a heater which generates heat when energized;

a fusing rotary member which is heated by the heat from the heater;

a pressing rotary member which is in pressed contact with the fusing rotary member so as to form a fusing nip through which paper having a toner image transferred thereto is passed to fuse the toner image to the paper;

an adjustment mechanism which adjusts a fusing pressure under which the fusing rotary member and the pressing rotary member are in contact with each other at the fusing nip, thereby to adjust a nip width of the fusing nip;

a temperature sensing member which senses temperature of the fusing rotary member, and a control portion which recognizes the temperature of the fusing rotary member based on an output from the temperature sensing member, the control portion, when the temperature of the fusing rotary member is lower than a fusing control temperature adequate for fusing of the toner image, energizing the heater to raise the temperature of the fusing rotary member up to the fusing control temperature, thereby to perform fusing warm-up operation, the control portion controlling the adjustment mechanism such that, during the fusing warm-up operation, the fusing pressure is at a preset first set value, after completion of the fusing warm-up operation, with the fusing pressure at a preset third set value, a first sheet of paper is passed through the fusing nip, and the fusing pressure is changed to a preset second set value before sheets of paper for a preset number of pages pass through the fusing nip after completion of the fusing warm-up operation, wherein, of the first, second, and third set values, the third set value is greatest, the second set value is second greatest, and the first set value is smallest.

2. The device according to claim 1, wherein the preset page is one of a third and following pages, and the control portion controls such that, the fusing pressure is reduced from the third set value gradually, each time a sheet of paper passes through the fusing nip, and the fusing pressure is set at the preset second set value before the preset page enters the fusing nip after completion of the fusing warm-up operation.

3. The device according to claim 1, wherein the preset page is a second page, and the control portion controls the adjustment mechanism such that the fusing pressure is set at the second set value after a sheet of paper for a first page has passed through the fusing nip before a sheet of paper for the second page enters the fusing nip.

4. The device according to claim 1, wherein, when the fusing pressure is at the first set value, the control portion controls the adjustment mechanism such that the fusing rotary member and the pressing rotary member are kept out of contact with each other.

5. The device according to claim 1, wherein, before starting the fusing warm-up operation, the control portion checks whether or not the temperature of the fusing rotary member is equal to or higher than the fusing control temperature so that, when the temperature of the fusing rotary member is equal to or higher than the fusing control temperature, the control portion controls the adjustment mechanism such that the fusing pressure is at the second set value.

6. The device according to claim 1, wherein the adjustment mechanism includes an adjustment motor and a cam, the adjustment mechanism adjusting the fusing pressure by varying position of a rotary shaft of the pressing rotary member by rotating the cam by using driving force generated by the adjustment motor.

7. An image forming apparatus comprising the device according to claim 1.

8. A method of controlling fusing pressure in a fusing device, comprising the steps of:

energizing a heater to generate heat;

heating a fusing rotary member with the heater;

bringing a pressing rotary member in pressed contact with the fusing rotary member so as to form a fusing nip through which paper having a toner image transferred thereto is passed to fuse the toner image to the paper;

adjusting by use of an adjustment mechanism a fusing pressure under which the fusing rotary member and the pressing rotary member are in contact with each other at the fusing nip, thereby to adjust a nip width of the fusing nip;

sensing temperature of the fusing rotary member;

when the temperature of the fusing rotary member is lower than a fusing control temperature adequate for fusing of the toner image, energizing the heater to raise the temperature of the fusing rotary member up to the fusing control temperature, thereby to perform fusing warm-up operation;

during the fusing warm-up operation, setting the fusing pressure at a preset first set value;

after completion of the fusing warm-up operation, with the fusing pressure set at a preset third set value, passing a first sheet of paper through the fusing nip; and changing the fusing pressure to a preset second set value before sheets of paper for a preset number of pages pass through the fusing nip after completion of the fusing warm-up operation, wherein, of the first, second, and third set values, the third set value is largest, the second set value is second largest, and the first set value is smallest.

9. The method according to claim 8, wherein the preset page is one of a third and following pages, the fusing pressure is reduced gradually, each time a sheet of paper passes through the fusing nip, and the fusing pressure is set at the preset second set value before the preset page enters the fusing nip after completion of the fusing warm-up operation.

10. The method according to claim 8, wherein the fusing pressure is set at the second set value after a sheet of paper for a first page has passed through the fusing nip before a sheet of paper for the second page enters the fusing nip.

11. The method according to claim 8, wherein, when the fusing pressure is at the first set value, the fusing rotary member and the pressing rotary member are kept out of contact with each other.

12. The method according to claim 8, wherein, before the fusing warm-up operation is started, whether or not the temperature of the fusing rotary member is equal to or higher than the fusing control temperature is checked so that, when the temperature of the fusing rotary member is equal to or higher than the fusing control temperature, the fusing pressure is at the second set value.

13. The method according to claim 8, wherein the fusing pressure is adjusted by varying position of a rotary shaft of the pressing rotary member by rotating a cam of the adjustment mechanism by using driving force generated by an adjustment motor of the adjustment mechanism.

* * * * *